US009777479B2

(12) United States Patent
Rice

(10) Patent No.: US 9,777,479 B2
(45) Date of Patent: Oct. 3, 2017

(54) FRAMING MEMBER HAVING REINFORCED END

(75) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 12/435,392

(22) Filed: May 4, 2009

(65) Prior Publication Data

US 2011/0067343 A1 Mar. 24, 2011

Related U.S. Application Data

(63) Continuation of application No. 10/655,619, filed on Sep. 5, 2003, now abandoned.

(51) Int. Cl.

| | |
|---|---|
| ***E04C 3/07*** | (2006.01) |
| ***E04B 1/24*** | (2006.01) |
| ***E04B 5/10*** | (2006.01) |
| *E04C 3/04* | (2006.01) |

(52) U.S. Cl.

CPC ..... *E04C 3/07* (2013.01); *E04B 1/24* (2013.01); *E04B 5/10* (2013.01); *E04B 2001/2415* (2013.01); *E04B 2001/2448* (2013.01); *E04B 2001/2457* (2013.01); *E04B 2001/2466* (2013.01); *E04C 2003/0421* (2013.01); *E04C 2003/0434* (2013.01); *E04C 2003/0473* (2013.01)

(58) Field of Classification Search

CPC ..... E04B 1/24; E04B 5/10; E04B 2001/2415; E04B 2001/2448; E04B 2001/2457; E04B 2001/2466; E04C 3/07; E04C 2003/0421; E04C 2003/0434; E04C 2003/0473

USPC ..... 52/653.1, 664, 633; 403/167; 29/897.31, 29/897.312, 897.35

See application file for complete search history.

(56) References Cited

U.S. PATENT DOCUMENTS

| | | | | | |
|---|---|---|---|---|---|
| 1,731,300 | A | * | 10/1929 | Ehlers | 182/228.1 |
| 1,867,449 | A | * | 7/1932 | Ecket et al. | 52/100 |
| 3,141,697 | A | * | 7/1964 | Tenenbaum et al. | 296/186.1 |
| 3,222,836 | A | * | 12/1965 | Collin et al. | 52/281 |
| 3,604,176 | A | * | 9/1971 | Campbell | 52/660 |
| 3,615,110 | A | * | 10/1971 | Fugate | 403/230 |
| 3,751,870 | A | * | 8/1973 | Vesei | 52/656.1 |
| 3,777,649 | A | * | 12/1973 | Luckey | 454/260 |
| 3,926,530 | A | * | 12/1975 | Deller | 403/167 |
| 4,042,991 | A | * | 8/1977 | Macy et al. | 14/77.1 |
| 4,093,167 | A | * | 6/1978 | Rooklyn | 248/188 |
| 4,204,587 | A | * | 5/1980 | Larson | 182/228.1 |
| 4,385,476 | A | * | 5/1983 | Slager | 52/846 |
| 4,593,509 | A | * | 6/1986 | Linton | 52/262 |
| 4,597,118 | A | * | 7/1986 | Mis | 5/246 |
| 4,608,801 | A | * | 9/1986 | Green et al. | 52/664 |
| 4,918,886 | A | * | 4/1990 | Benoit et al. | 174/497 |

(Continued)

FOREIGN PATENT DOCUMENTS

CA 2401289 A1 * 3/2004 ..... E04B 5/10

*Primary Examiner* — James Ference

(57) ABSTRACT

The present invention is directed to a framing member for use in a steel framed flooring structure. The framing member has a U-shaped rectangular cross section with two parallel spaced apart flanges and a central web bridging the flanges and connected to one edge of each of the flanges. The central web has an extension on each end thereof, the extension extending beyond the flanges a distance of at least half the width of the flange.

11 Claims, 4 Drawing Sheets

(56) References Cited

U.S. PATENT DOCUMENTS

| | | | | |
|---|---|---|---|---|
| 5,007,216 | A * | 4/1991 | Pearson | 52/94 |
| 5,185,974 | A * | 2/1993 | Diehl | 52/95 |
| 5,189,857 | A * | 3/1993 | Herren et al. | 52/317 |
| 5,440,848 | A * | 8/1995 | Deffet | 15/376 |
| 5,579,622 | A * | 12/1996 | DeVon et al. | 52/653.1 |
| 5,596,859 | A * | 1/1997 | Horton et al. | 52/481.1 |
| 5,625,995 | A * | 5/1997 | Martin | 52/715 |
| 5,664,388 | A * | 9/1997 | Chapman et al. | 52/653.1 |
| 5,857,306 | A * | 1/1999 | Pellock | 52/643 |
| 5,884,448 | A * | 3/1999 | Pellock | 52/643 |
| 5,956,916 | A * | 9/1999 | Liss | 52/655.1 |
| D423,325 | S * | 4/2000 | Liss | D8/349 |
| 6,176,053 | B1 * | 1/2001 | St. Germain | 52/232 |
| 6,260,318 | B1 * | 7/2001 | Herren | 52/317 |
| 6,301,854 | B1 * | 10/2001 | Daudet et al. | 52/650.1 |
| 6,354,055 | B1 * | 3/2002 | Shaw et al. | 52/712 |
| 6,412,325 | B1 * | 7/2002 | Croswell | 72/324 |
| 6,418,694 | B1 * | 7/2002 | Daudet et al. | 52/650.1 |
| 6,427,416 | B1 * | 8/2002 | Rassel | 52/714 |
| 6,430,890 | B1 * | 8/2002 | Chiwhane et al. | 52/715 |
| 6,688,000 | B2 * | 2/2004 | Wang et al. | 29/897.2 |
| 6,761,005 | B1 * | 7/2004 | Daudet et al. | 52/272 |
| 2002/0035815 | A1 * | 3/2002 | Daudet et al. | 52/702 |
| 2002/0046525 | A1 * | 4/2002 | Rice | 52/481.1 |
| 2003/0145537 | A1 * | 8/2003 | Bailey | E04B 1/4178 52/210 |
| 2004/0144057 | A1 * | 7/2004 | Meek | E04B 2/58 52/656.2 |
| 2004/0163356 | A1 * | 8/2004 | Rice | 52/720.1 |
| 2006/0016139 | A1 * | 1/2006 | Beck | E04B 1/24 52/289 |
| 2006/0037273 | A1 * | 2/2006 | Hashimoto et al. | 52/633 |
| 2006/0185312 | A1 * | 8/2006 | Weeks | 52/653.1 |
| 2006/0265997 | A1 * | 11/2006 | Collins, Jr. | E04C 3/07 52/837 |
| 2007/0193202 | A1 * | 8/2007 | Rice | 52/733.2 |
| 2007/0199274 | A1 * | 8/2007 | Rice | 52/712 |
| 2007/0251186 | A1 * | 11/2007 | Rice | 52/733.2 |
| 2010/0146902 | A1 * | 6/2010 | Hashimoto et al. | 52/653.1 |

* cited by examiner

FRAMING MEMBER HAVING REINFORCED END

CROSS REFERENCE TO EARLIER APPLICATION

This application is a continuation of application Ser. No. 10/655,619, filed Sep. 5, 2003, now abandoned.

FIELD OF THE INVENTION

The present invention is directed to a metal framing member, particularly a metal floor joist, having an integral reinforced end.

BACKGROUND OF THE INVENTION

The framing of buildings for residential and commercial construction has traditionally been accomplished using suitably dimensioned wood members. While the use of wood members makes the construction relatively simple, the use of wood members has its shortcomings. The supply of lumber is getting scarcer and costs have increased during recent years. In addition wood can warp and go out of shape when it becomes wet as well as being susceptible to attack by vermin of various kinds including termites.

In recent years buildings framed with sheet metal framing members have been employed. The use of sheet metal framing members provides advantages of dimensional stability, ease of manufacture and conservation of natural resources among others. However the use of sheet metal members, particularly, joists has not gained widespread acceptance for various reasons. One such reason is that the ends of the joists where they are attached to a vertical wall require that they be securely attached to the rim joist and that they be provided with some reinforcement to provide the joist with the capability of supporting the load at the ends. In the past this has commonly been accomplished by using an L shaped bracket of a height about equal to the web of the joist. One leg of the bracket is attached to the web at the end of the joist and the other leg is attached to the web of the rim joist. Another solution employs a section of steel stud or track equal in height to the height of the joist web. The web of the stud or track section is attached to the web of the joist and one flange of the stud is attached to the web of the rim joist. A variation on this is shown in U.S. Pat. No. 5,625,995 issued May 6, 1997 to Byron Martin. This patent describes a special bracket shaped like a stud section for attaching this joist to the header. While these solutions provide the required attachment and reinforcing for the floor joist, they significantly increase the labor time required to install the steel joist system. Consequently steel joist systems have not gained widespread acceptance among the framing trades.

A modified ledger or rim joist has recently been described in U.S. Pat. No. 5,956,916 issued Sep. 18, 1999 assigned to Steel Floor Ltd. in an attempt to overcome the above problems. The web of the ledger is provided with struck out tabs which extend perpendicularly inwardly of the web at a regular spacing, typically 16 inches on center. The tabs act as a locating means and attachment means for the floor joist as well as reinforcing the end of the web of the floor joist. While the modified ledger joist makes the attachment of the floor joist easier, it also introduces new problems. The alignment of the ledger must be closely controlled so that the floor joists spanning the space between the ledge will be properly aligned with the struck out tabs. This will require additional labor time by the framing trades. Additionally, as the location of the tabs are fixed at the time of manufacturing of the ledger, the flexibility in the spacing of the floor joists is limited. In some cases such as to avoid a service stack or to provide additional support below partition walls, it may be necessary to adjust the spacing of the floor joist or to install additional joists. In addition if the load characteristics change, the joist spacing required to support the load may change. Another situation where the floor joists will not properly align with the tabs is if the floor joist meets the ledger joist at other than right angles, e.g. 45 degree angles commonly encountered in bay window bump outs. In those cases, another means for providing the attachment and reinforcing of the end of the joist would be required such as the bracket or stud section described above, thus defeating the advantages of the modified rim joist.

There thus still remains a need for an easy to install means of attaching a steel framing members such as a steel joist to a supporting framing member such as a rim joist and reinforcing the end of the framing member.

SUMMARY OF THE INVENTION

The present invention is directed to a framing member for use in a steel framed structure. The framing member has a U-shaped rectangular cross section with two parallel spaced apart flanges and a central web bridging the flanges and connected to one edge of each of the flanges. The central web has an extension on each end thereof, the extension extending beyond the flanges a distance of at least half the width of the flange.

BRIEF DESCRIPTION OF THE DRAWINGS

Preferred embodiments of the present invention are illustrated in the attached drawings of which.

DETAILED DESCRIPTION OF THE PREFERRED EMBODIMENTS

Figure 1:
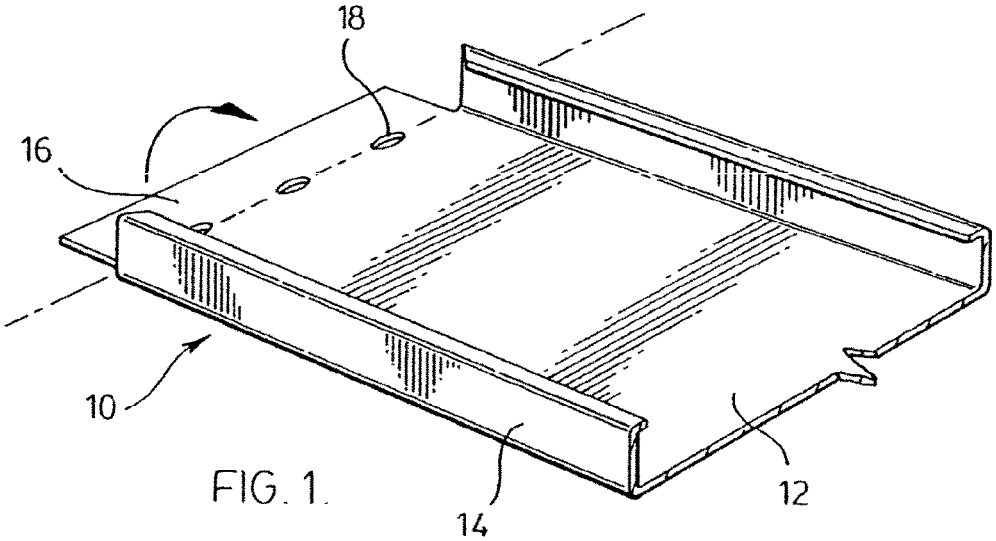
FIG. 1 is a perspective view of a floor joist constructed in accordance with the present invention.
Figure 2:
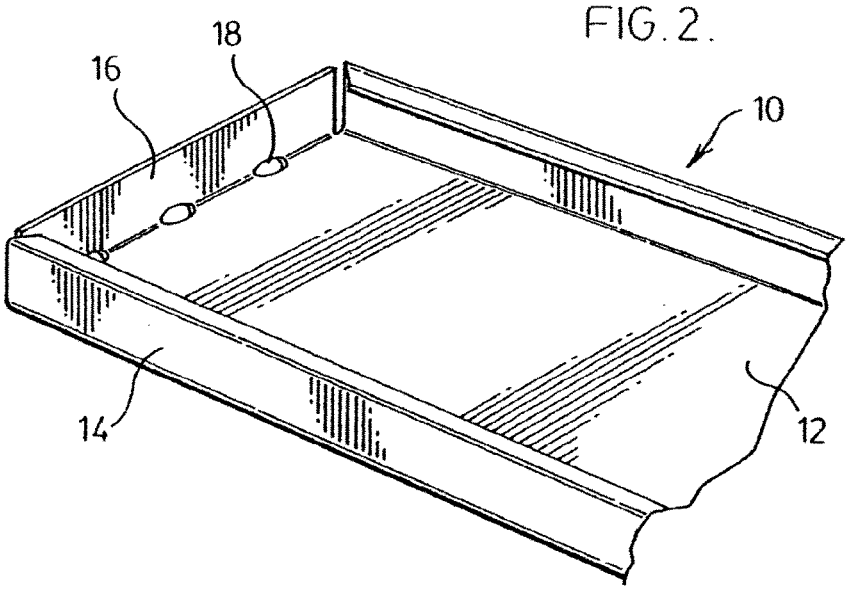
FIG. 2 is a perspective view of the end of the floor joist of FIG. 1.

A first preferred embodiment of a framing member, particularly a floor joist according to the present invention is illustrated in the attached figures generally indicated by the numeral 10.

The floor joist 10 has a generally C shaped cross section with a web 12 spanning two parallel flanges 14 at opposite edges of the web 12. The opposite edge of the flanges 14 have an inwardly turned extension to strengthen the flanges when under load. The central web 12 is provided with extensions 16 on each end, the extension 16 having a height slightly less than the height of the web 12. The extension 16 extends beyond the end of the flange 14 a distance of at least half the width of the flange 14. Preferably the extension 16 extends beyond the end of the flange 14 a distance of about the width of the flange 14. When the joist is manufactured, the extensions 16 lie in the plane of the web 12 this allowing the joist to be easily stacked for transportation. In order to make the bending of the extension 16 easier, slots 18 are provided along the desired bend line 20 between the web 12 and the extension 16. The provision of the slots 18 also forces the extension 16 to be bent along this line.

In the construction of a floor, the rim or header joists 30 are attached to the wall, generally by being attached to the top plate 40 of the wall or being directly attached to the vertical surface of a stud 42 of the wall as is common in balloon framing and with walls formed from insulated concrete forms. The extensions 16 of the floor joists 10 are bent, generally perpendicular to the web 12. The end of the joist 10 is placed in the opening of the rim joist 30, butting the extension 16 against the web 32 of the rim joist 10. The extension 16 is then screwed to the web 32 of the rim joist 30 by suitable screws 36 and the flange 14 of the floor joist 10 secured to the flange 34 of the rim joist 30 by screw 36.

Figure 4:
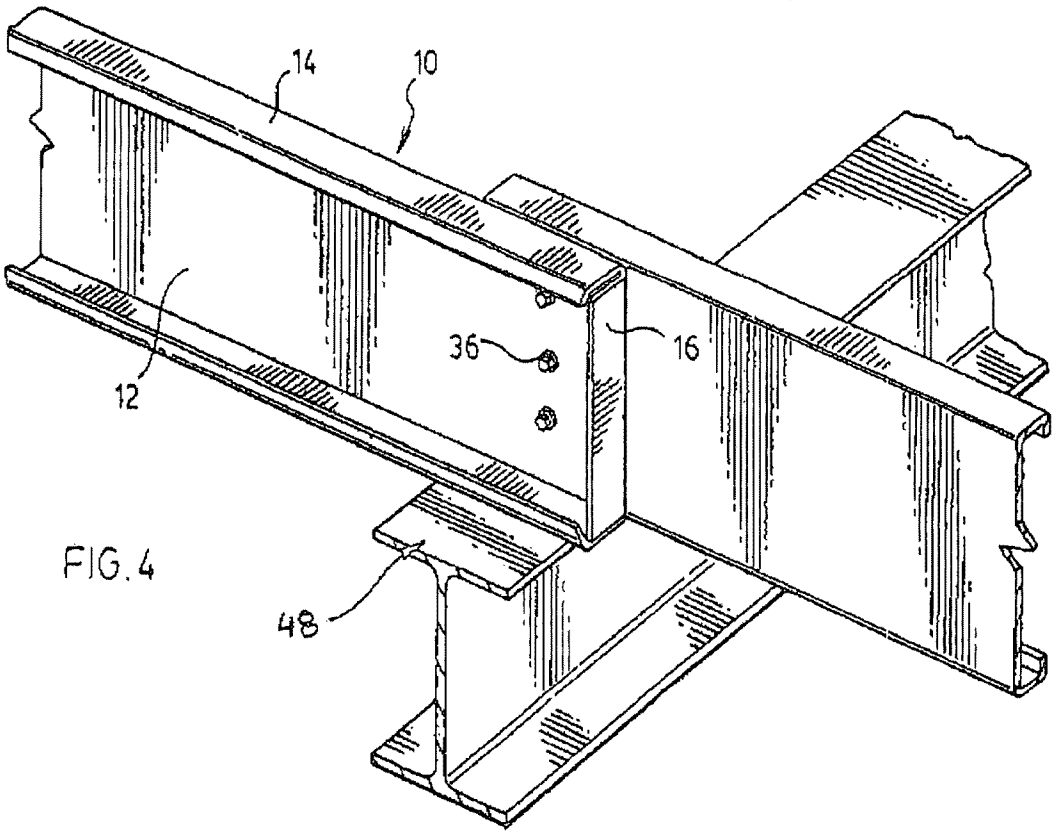
FIG. 4 is a perspective view of two floor joists of FIG. 1 meeting over a beam.
Figure 6:
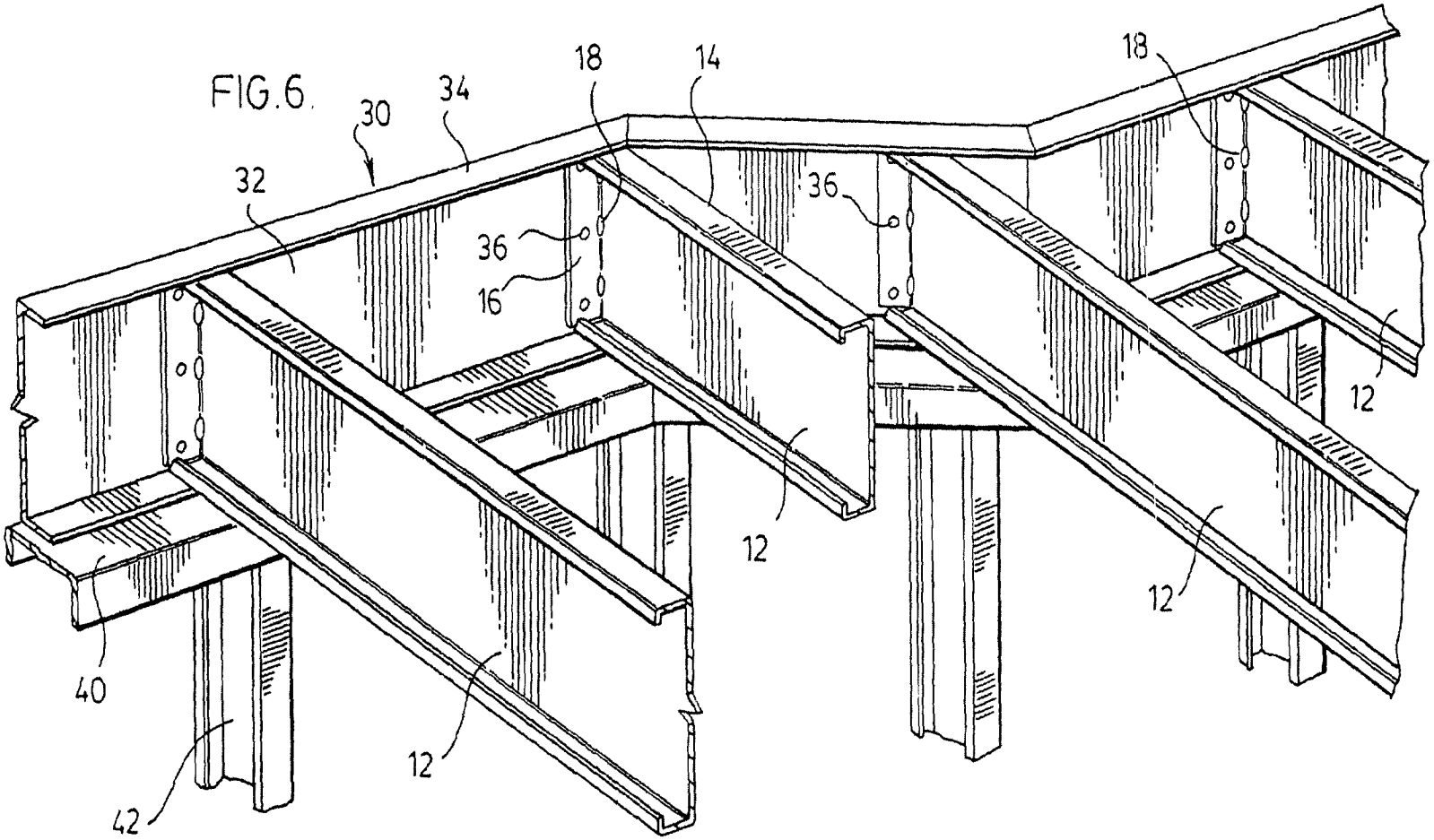
FIG. 6 is a perspective view of a second floor constructed using the floor joist of FIG. 1.

As illustrated in FIG. 4, when two floor joists 10 meet over a beam 48, the extensions 16 reinforce the ends of the joists 10. In those situations, the webs 12 of the joists are attached to one another with suitable fasteners such as screws 36 or bolts. The flange 14 of the floor joists 10 are secured to the beam 48 by suitable fasteners such as screws 36.

Figure 5:
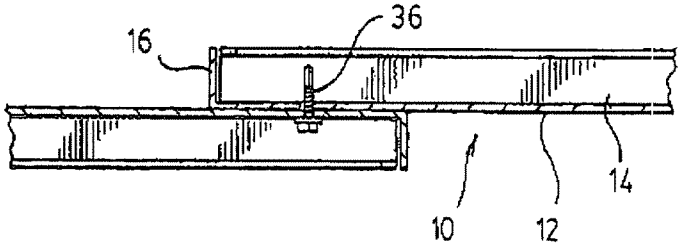
FIG. 5 is a top plan view of the joists of FIG. 4.

As illustrated in FIG. 5, the floor joists 10 of the present invention are of particular use where the joists 10 connect to the rim joist or header at other than right angles. In these circumstances, the extension 16 of the floor joist 10 is bent at an angle to match the angle between the floor joist 10 and rim joist 30. In this way, the extension 16 butts against the web 32 of the rim joist 30 and is easily secured to the web 34 of the rim joist 30.

The framing member of the present invention is manufactured using typical machinery such as roll formers to bend the flanges from a suitable sized blank of metal. The extension and slots may be formed by a cutting machine either before or after the roll forming operation. Once produced the framing members are easily stackable one within another in the typical manner as there are no protrusions beyond the usual C shaped cross section.

The dimensions of the framing members of the present invention are those typically used in metal forming. Floor joists produced in accordance with the present invention typically have a depth of 8 to 14 inches, more preferably 8, 10 or 12 inches and the flanges are typically 1½ to 2 inches wide. The joist are typically formed of 14 to 20 gauge steel, most preferably 16 or 18 gauge.

Figure 3:
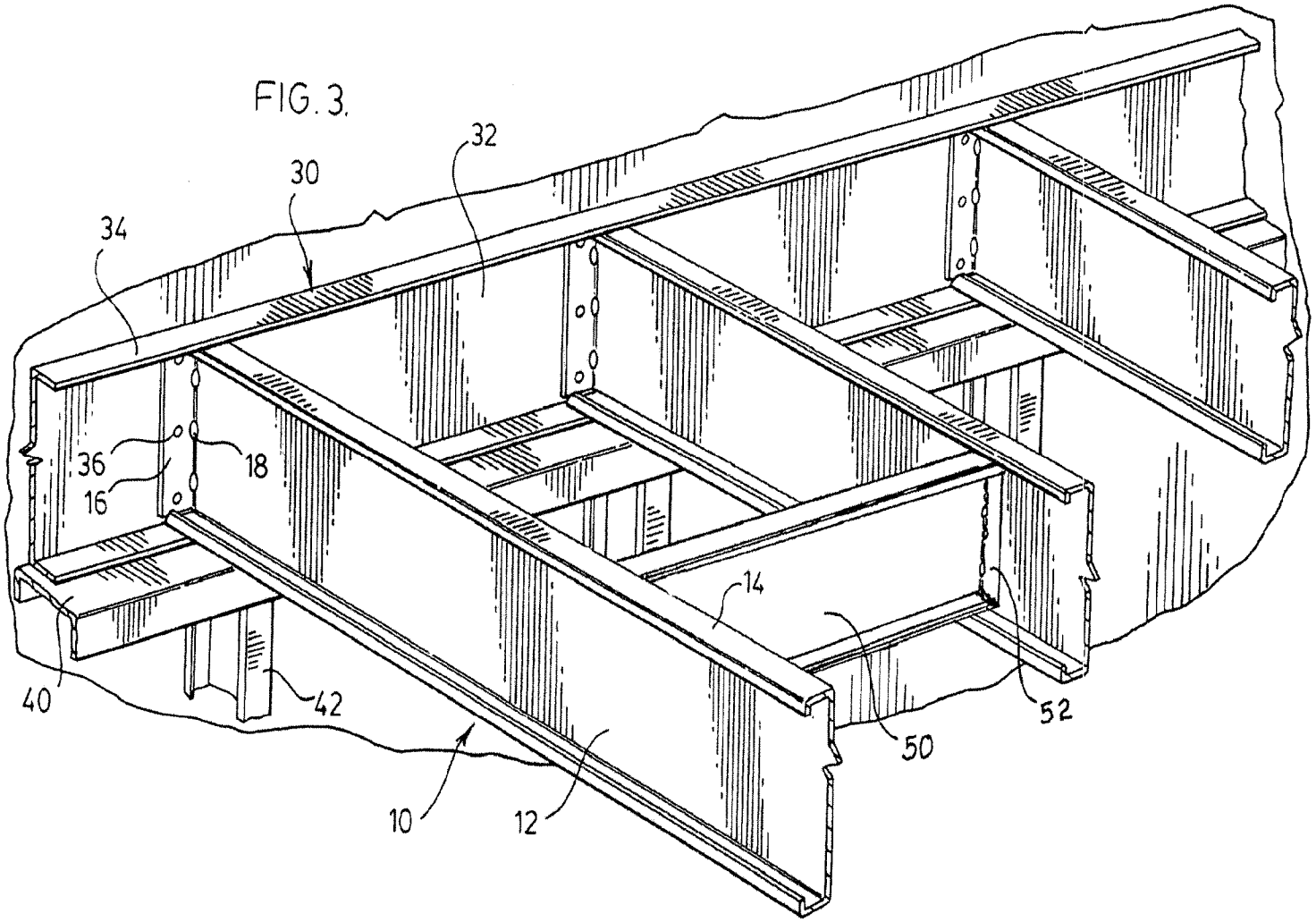
FIG. 3 is a perspective view of a floor constructed using the floor joist of FIG. 1.

As illustrated in FIG. 3, the provision of the reinforced end is also of use in the construction of bridging members 50 which are used to interconnect two joists 10 intermediate their ends. The bridging member 50 is provided with the extensions 52 on either end which are bent over to allow the bridging member 50 to be attached to the webs 12 of the joists 10 by screwing through the extensions 52 and into the web 12 of the joist 10. The length of the bridging member is the same as the spacing between the joists 10, typically 16 inches, although other lengths are possible depending upon the design of the floor. In order to allow the bridging member 50 to fit between the inwardly turned extensions of the flanges 14, the height of the bridging member is selected to be equal to or less than the spacing between the inwardly turned extensions. Typically for 8 and 10 inch joists, the height of the bridging member will be 6 inches. This allows the bridging member to fit in the space and be formed using the machinery generally used for 6 inch steel framing members.

The extensions may also be used to reinforce the ends of lintels formed by attaching two joists of the required length together back to back, each of the joists having the extensions at either ends. The extensions are bent over to be attached to the studs framing the opening bridged by the lintel.

The framing member, particularly the floor joist of the present invention provides for numerous advantages over those of the prior art. The securement of the floor joist to the rim joist does not require the use of additional support members such as brackets or short sections of metal studs, thus resulting in significant labour savings. Similarly, the connection of two floor joists to one another over a beam does not require additional support members, also resulting in labour savings. The floor joists of the present invention are also easily adaptable to situations where the floor joists meet the rim joist or header at other than right angles.

Although various preferred embodiments of the present invention have been described herein in detail, it will be appreciated by those skilled in the art, that variations may be made thereto without departing from the spirit of the invention or the scope of the appended claims.

I claim:

1. A steel framed floor comprising:

at least one rim joist attached to a wall; the rim joist being a metal member having a generally U shaped rectangular cross section with two parallel spaced apart rim joist flanges and a rim joist central web bridging the rim joist flanges;

a plurality of floor joists each being a metal member having a generally C shaped rectangular cross section with two parallel spaced apart flanges and a central web bridging the flanges, each floor joist having two ends with at least one of said the two ends contained within and attached to the rim joist; each floor joist positioned in a parallel spaced apart relationship to each other and generally perpendicular to the rim joist to generally align the flanges of the floor joists with the rim joist flanges;

the central web of each of the floor joists having an integral extension of the web located at and continuous with each of the two ends of the web, the two extensions of the web being bent inwardly between said two parallel spaced apart flanges of the floor joist to reinforce the end of the central web of the floor joist, and at least one of the extensions of the one of the two ends and the spaced apart flanges of the floor joist are contained within the rim joist with the at least one of the extensions abutting against the rim joist central web and being directly attached thereto by at least one screw.

2. The steel framed floor according to claim 1 wherein each floor joist is provided with slots between the central web and each of the extensions to allow the extensions to be easily bent.

3. The steel framed floor according to claim 2 wherein each floor joist flange has a width and each of the extensions have a width equal to the width of the floor joist flanges.

4. The steel framed floor according to claim 2 wherein each floor joist flange has a width and each of the extensions have a width equal to at least half the width of the floor joist flanges.

5. The steel framed floor according to claim 1, further comprising a beam, wherein one of said plurality of floor joists meets another floor joist over the beam, wherein said another floor joist comprises a metal member having a generally C shaped rectangular cross section with two parallel spaced apart flanges and a central web bridging the flanges, the central web of said another floor joist having an integral extension of the central web located at and continuous with an end of the central web which meets the one of said plurality of floor joists, wherein the extension of the web of said another floor joist is bent inwardly between said two parallel spaced apart flanges of the floor joist to reinforce the end of the central web of said another floor joist.

6. The steel framed floor according to claim 5, wherein the central web of the one of said plurality of floor joists is connected to the central web of said another floor joist by at least one screw.

7. The steel framed floor according to claim 5, wherein the central web of the one of said plurality of floor joists is connected to the central web of said another floor joist by at least one bolt.

8. The steel framed floor according to claim 1, wherein one of said two extensions of at least one of the plurality of floor joists is bent inwardly at an angle other than a right angle.

9. The steel framed floor according to claim 8, wherein the angle other than the right angle matches an angle between said at least one of the plurality of floor joists and the rim joist.

10. The steel framed floor according to claim 8, wherein the one of said two extensions of said at least one of the plurality of floor joists is bent inwardly along a bend line in the central web of said at least one of the plurality of floor joists having a plurality of slots cut along the bend line.

11. A steel framed floor comprising:

at least one rim joist attached to a wall; the rim joist being a metal member having a generally U shaped rectangular cross section with two parallel spaced apart rim joist flanges and a rim joist central web bridging the rim joist flanges;

a plurality of floor joists each being a metal, member having a generally C shaped rectangular cross section with two parallel spaced apart flanges and a central web bridging the flanges, each floor joist having two ends with at least one of said the two ends contained within and attached to the rim joist; each floor joist positioned in a parallel spaced apart relationship to each other and generally perpendicular to the rim joist to generally align the flanges of the floor joists with the rim joist flanges;

the central web of each of the floor joists having an integral extension of the web located at and continuous with each of the two ends of the web, the two extensions of the web being bent inwardly between said two parallel spaced apart flanges of the floor joist to reinforce the end of the central web of the floor joist, and at least one of the extensions of the one of the two ends and the spaced apart flanges of the floor joist are contained within the rim joist with the at least one of the extensions abutting against the rim joist central web, wherein the central web of each of the floor joists is directly attached to the rim joist central web without additional support members other than screws.

* * * * *